United States Patent [19]

Duclos

[11] 4,128,244

[45] Dec. 5, 1978

[54] ALIGNMENT DEVICE FOR GOLF CLUBS

[76] Inventor: Clovis R. Duclos, 6371 El Paseo Ct., Long Beach, Calif. 90815

[21] Appl. No.: 781,158

[22] Filed: Mar. 28, 1977

Related U.S. Application Data

[63] Continuation-in-part of Ser. No. 625,940, Oct. 28, 1975, abandoned.

[51] Int. Cl.[2] ..... A63B 53/04

[52] U.S. Cl. ..... 273/164

[58] Field of Search ..... 273/77 R, 78, 80 C, 273/163 R, 163 A, 164, 167–175, 183 D, 194 R, 194 A, 193 R; D34/5 GH

[56] References Cited

U.S. PATENT DOCUMENTS

| | | | |
|---|---|---|---|
| D. 200,416 | 2/1965 | Leeah | 273/164 X |
| D. 203,512 | 1/1966 | Solheim | 273/167 D X |
| D. 213,118 | 1/1969 | Onaka | 273/164 X |
| D. 228,513 | 10/1973 | Brower | 273/164 X |
| D. 232,316 | 8/1974 | Cook | 273/164 X |
| D. 235,893 | 7/1975 | Becker | 273/164 X |
| D. 243,968 | 4/1977 | Whittaker | 273/164 X |
| 1,046,343 | 12/1912 | Smith | 273/164 |
| 1,690,388 | 11/1928 | Waldron | 273/164 X |
| 2,445,718 | 7/1948 | Sternberg et al. | 273/77 R X |
| 2,842,369 | 7/1958 | East | 273/164 |
| 2,865,635 | 12/1958 | Jessen | 273/163 R X |
| 3,042,405 | 7/1962 | Solheim | 273/78 X |
| 3,061,310 | 10/1962 | Giza | 273/78 |
| 3,199,873 | 8/1965 | Surratt | 273/163 R |
| 3,722,887 | 3/1973 | Cochran et al. | 273/164 X |
| 3,826,495 | 7/1974 | Elkins | 273/164 X |
| 3,880,430 | 4/1975 | McCabe | 273/164 X |
| 3,884,468 | 4/1975 | Cook | 273/78 |
| 3,888,492 | 6/1975 | Cabot | 273/164 X |

FOREIGN PATENT DOCUMENTS

| | | | |
|---|---|---|---|
| 324620 | 1/1930 | United Kingdom | 273/164 |

OTHER PUBLICATIONS

"Golf Digest"; Apr. 1974; p. 122.

*Primary Examiner*—Richard J. Apley
*Attorney, Agent, or Firm*—George W. Finch

[57] ABSTRACT

An improvement to golf club heads which includes a slot or notch which extends through a portion of the head generally behind the preferred ball striking position of the club face wherein the slot enables proper eye, golf club head alignment. Additional indicia means can be included along the sides of the slot or on the back surface behind it to indicate further adjustments for golfers of different sizes or for intentional hooking or slicing of the ball. The slot angle may be adjustable.

4 Claims, 14 Drawing Figures

ALIGNMENT DEVICE FOR GOLF CLUBS

BACKGROUND OF THE INVENTION

The game of golf is a demanding exercise in consistency, therefore, it has always been desired to take as many variables out of an individual's golf swing as possible. Heretofore, various devices such as indicia lines, mirrors, spirit levels and other sighting devices have been included on golf clubs to assist the golfer in maintaining the same position with respect to the ball and the club head for each type of club that he uses during a round of golf. None, however, eliminates the variables which are eliminated by the present invention while being within the rules of the golfers' rulemaking organizations.

When putting it is desirable for the player's eyes to be vertically over the golf ball and in alignment with the desired path of the ball. When this is properly done, the putt can be the easiest shot in a golfer's repertoire. Wood or iron shots on the other hand, require that the eyes be at a predeterminable angle with respect to vertical. It is preferable that this angle remain constant for each club that the golfer uses. This assures that at least one more variable has been removed from the almost infinite number of variables involved in hitting a golf ball in the desired direction with the proper spin, height and distance. It should be obvious that if the eyes are not properly aligned with the golf club head for any given shot, that a parallax problem is introduced which is worse if the golfer's two eyes are not in the plane of the ball's expected flight. Any parallax requires that he continually make compensations from shot to shot which introduce additional variables.

BRIEF SUMMARY OF THE INVENTION

The present invention solves the problems of the prior art devices by providing a deeply slotted portion or means simulating the same, placed toward the rear of the golf club head which is aligned with the plane along which both of the golfer's eyes should lie and the line along which it is desired to hit the golf ball. In the usual case, the slot is also aligned with the center of percussion of the golf club head which is sometimes called the sweet spot. The slot therefore enables the golfer to align his club face properly in the direction that he wishes to strike the ball, align the club with the ball so that the ball is struck at the sweet spot of the club and also mantain his eyes in perfect alignment so that from swing to swing his head and hence, the upper portion of his body, is maintained in a consistent position during his address of the golf ball.

It should be noted that most good golfers perform the abovementioned procedures instinctively and therefore only have need for such a device when their game is going badly due to misalignment problems of the eye, the sweet spot or the club face. However, the large proportion of golfers are not in this class and require assistance at least during their learning stages so their game improves at a rapid rate thus making golf a less frustrating and more enjoyable experience. It should be added that there are circumstances on a golf course but it is desired to vary one's eye, sweet spot, club fact alignment and these variations can be accommodated by visually obvious indicia means placed at the bottom or along the sides of the slot.

It is therefore the principle object of the present invention to provide means which enable eye, center of percussion, club face alignment to improve the consistency of a golfer's stroke.

Another object is to eliminate eye parallax when a golfer is putting.

Another object is to provide an adjustable alignment device so that a golfer may vary his eye, center of percussion, club face alignment for intentionally hooking or slicing a golf ball a known amount.

Another object is to provide an alignment device to improve a golfer's game which can be incorporated into golf clubs of various kinds and shapes.

Another object of the present invention is to provide an alignment device which can be added to existing golf clubs and can be adjusted to the needs of the individual golfer.

These and other objects and advantages of the present invention will become apparent to those skilled in the art after considering the following detailed specification which covers preferred embodiments thereof in conjunction with the accompanying drawings wherein:

DESCRIPTION OF THE PRESENT EMBODIMENTS

Figure 1:
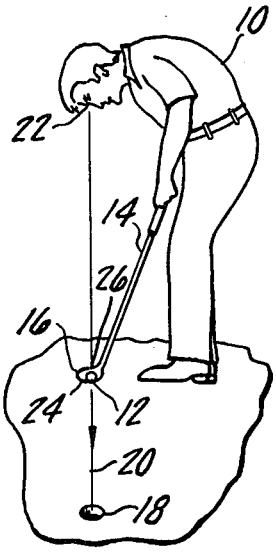
FIG. 1 is a schematic representation of a golfer addressing a golf ball in a putting position showing the preferred alignment of eyes, club face and ball movement direction.
Figure 2:
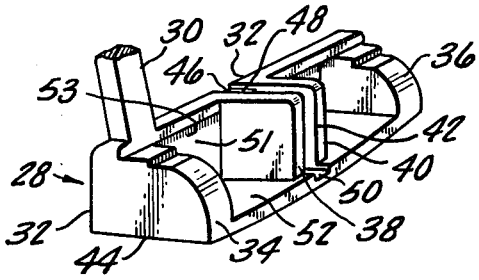
FIG. 2 is a perspective view of a heel and toe balanced head for a putter incorporating the alignment slot of the present invention.

Referring to the drawings more particularly by reference numbers, number 10 in FIG. 1 refers to a golfer addressing a ball 12 with a putter 14, whose head 16 is in position to strike the ball 12 toward the cup 18 along line 20. It should be observed that the golfer's eyes 22 are directly above the golf ball 12 and in alignment with the line 20 along which it is desired to strike the ball 12. When the golfer 10 is in this position it is desirable that the face 24 of the head 16 be at right angles to the line 20 so that the ball 12 is propelled in the desired direction along line 20. Every golf club face 24 has a center of percussion 26 which is generally centrally located on the club face 24 and whose exact position depends upon the design of the club 14. It is difficult, especially for a fledgling golfer to maintain the alignment shown in FIG. 1 and therefore, as shown in FIG. 2, the present invention includes means which enable the golfer 10 to automatically see the proper alignment of his eyes, the center of percussion and the golf club head while addressing the ball 12. FIG. 2 shows a putter head 28 which is attached to a golf club shaft (not shown) by the extension 30. The putter head includes a face 32 for striking the ball, weights 34 and 36 at the opposite ends thereof to heel and toe balance the club and a pair of upstanding walls 38 and 40 which define a slot 42 therebetween. The slot 42 is aligned at 90° to the face 32 and the undersurface 44 and is also preferably located just behind the center of percussion 46 of the head 28. It should be noted that the walls 38 and 40 seem to extend to the club face 32, an illusion created by cutting a shallow slot 48 behind the face 32 which is an extension of the slot 42. The slot 42 can also be extended down below and behind the walls 38 and 40 by cutting a shallow slot 50 into the base 52 of the club head 28. However, it is preferable that the walls 38 and 40 do not extend to the back side of the face 32. This allows the thin wall 53 therebetween (approximately 100/1000 of an inch) to flex during a shot and provide a good "feel" to the golfer 10.

When a golfer addresses the ball 12 with such a club head 28, he places the undersurface 44 of the club head 28 on the ground so that the slot 42 with its optional extensions 48 and 50 are directly behind the ball. He then aligns the slot 42 with the direction in which he wishes to hit the ball, moving his eyes until they can see the bottom of the slot 42 shown as the shallow slot 50. Once this has occurred the golfer is assured that his eyes, the center of percussion, the club face and the direction he wishes to hit the ball are all aligned, removing many variables from the complex geometrical problem involving with striking the golf ball in the desired direction.

Figure 3:
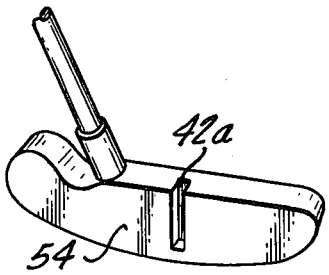
FIG. 3 is a perspective view of the head of a blade putter also having the present invention incorporated therein.
Figure 4:
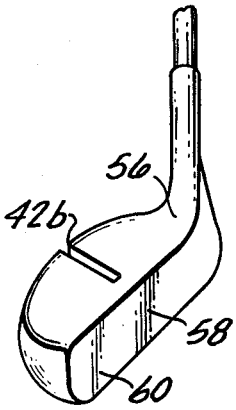
FIG. 4 is a perspective view of the club head of a mallet putter also employing the slot of the present invention.

The slot 42 can be incorporated into existing clubs as is shown in FIGS. 3 and 4 wherein slots 42 and 42*b* are incorporated into a blade-type putter head 54 and a mallet type putter head 56, respectively. The center of percussion 58 and the striking surface or face 60 of the mallet head club 56 are clearly shown in FIG. 4 with the center of percussion 58 aligned with the slot 42*b* and the face 60 at right angles thereto.

Figure 5:
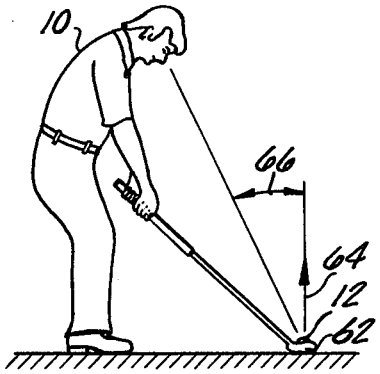
FIG. 5 is a diagrammatic representation of a golfer addressing the golf ball with either a wood or an iron showing the proper alignment between the golfer's eyes and the golf club head.

In FIG. 5 the golfer 10 is shown from behind addressing the ball 12 as he would if he had a wood or iron club with a wood club 62 being shown. It should be noted that the golfer's eyes 22 are still aligned side to side with the desired path 64 of the ball 12. However, an angle 66 has been established from vertical with respect to the desired path 64 so that the proper swing motion can take place after the addressing of the ball 12.

Figure 6:
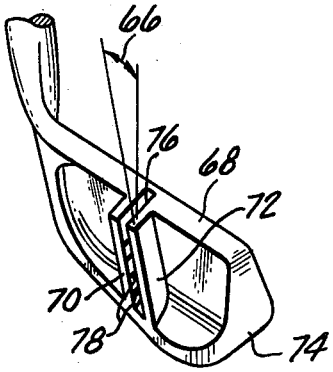
FIG. 6 is a perspective view of an iron club head showing an angled slot to correspond to the angle shown in FIG. 5 and indicia means therein for intentional hooking and slicing.

As shown in FIG. 6, the angle 66 can be permanently constructed into an iron club head 68 by merely forming two walls 70 and 72 at an angle with respect to the undersurface 74 of the club 68.

The slot 76 formed therein is the same as the slots 42, 42*a*, and 42*b* shown formed in the prior club heads. The walls 70 and 72 may include indicia means such as the lines 78 shown. These lines enable a golfer to misalign his eyes a given amount from directly down the slot 76 so that he can induce hooks or slices when so desired. In choosing one line 78 in the slot 76 the golfer chooses the amount of hook or slice so that he can adapt his shot to the playing conditions at hand. The indicia means 78 are usually only included on irons or woods since the normal use of a putter precludes hooks or slices.

Figure 7:
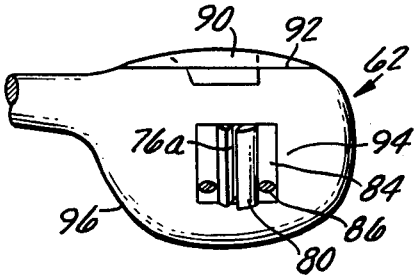
FIG. 7 is a top view of the head of a wood club showing a rotatable slot which can be adjusted to the proper angle to align the golfer's eyes with the club.
Figure 8:
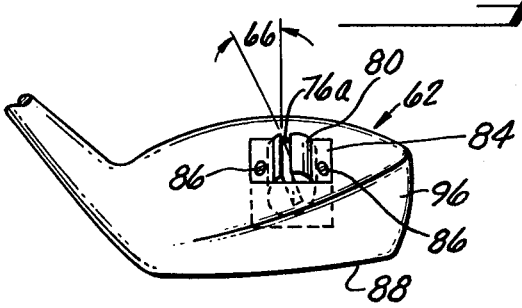
FIG. 8 is a rear view of the club head of FIG. 7.

FIGS. 7 and 8 show means for providing a slot 76*a* similar to slot 76 in the wood club 62. The slot 76*a* is shown formed partially through a cylindrical member 80 which is rotatable in a cylindrical surface of a base member 84. Retention means such as set screws 86 are provided in the base 84 which bear aganst the cylindrical member 80 and retain it in a desired angular relationship with respect to the undersurface 88 of the club 62. It can be seen, however, that the slot 76*a* although placed at an angle 66 with respect to the undersurface 88 still is maintained in alignment with the center of percussion 90 and at right angles to the club face 92. The adjustable feature of the angle 66 enables the pro shop of sporting goods store to eliminate a wide variety of clubs from their inventory. The wide variety would otherwise be required because the angle is not the same for all golfers and varys depending upon the style and size of the golfer 10. The whole assembly consisting of the cylindrical member 80, the base member 84, and the set screws 86 can be retrofitted into existing golf clubs by merely chiseling a suitable space 94 in the body 96 of the club 62.

Figure 9:
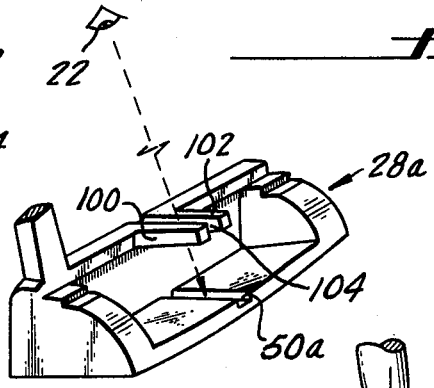
FIG. 9 is a perspective view of the head of a putter similar to that shown in FIG. 2 in which a central portion of the slot forming walls has been eliminated to enable easy fabrication and to balance and/or lighten the club head.

FIG. 9 shows a modified form 28*a* of the putter head 28 of FIG. 2 wherein the walls 38 and 40 of the head 28 have been modified so that they are essentially formed by two parallel rearwardly extending members 100 and 102 spaced above the shallow slot 50*a* which could be a mere painted line. The golfer's eyes 22 look through the space 104 defined between the members 100 and 102 to a painted line or, as shown, the shallow slot 50*a* so that the same alignment possible with the club 28 can be obtained by the use of the modified club 28*a* without the weight of the walls 38 and 40 and the difficult casting problem that in some instances they present. Although the slot 104 is shown, a single member 100 or 102 properly placed can be used in place of the slot 104 as the alignment device by positioning one's eyes so that the member blocks the view of the slot 50*a*.

Figure 10:
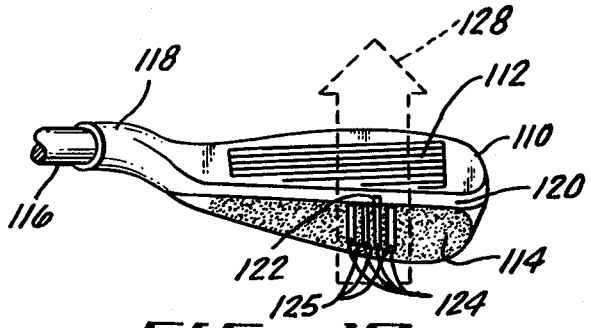
FIG. 10 is a top view of a modified club head having multiple alignment lines in the back surface thereof and an alignment notch in its top surface.
Figure 11:
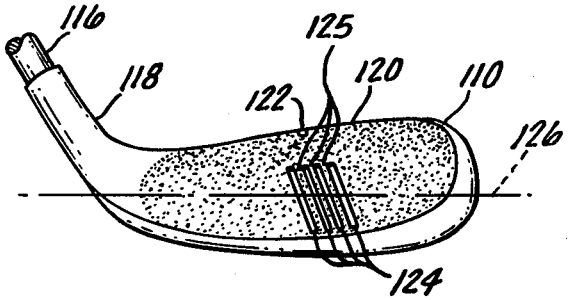
FIG. 11 is a back view of the club head of FIG. 10.
Figure 12:
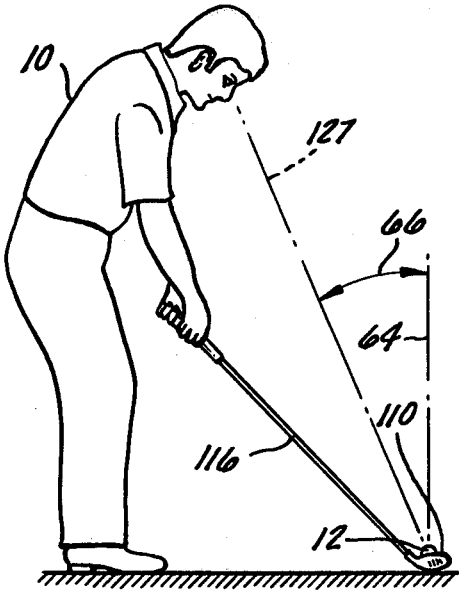
FIG. 12 is a view similar to FIG. 5 with the club head of FIGS. 10 and 11.
Figure 13:
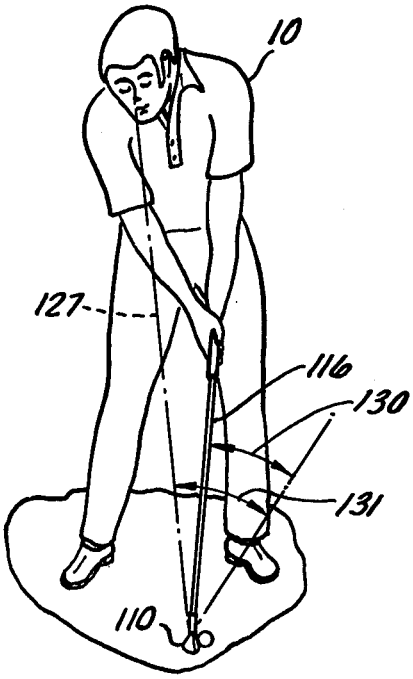
FIG. 13 is a view 90° from FIG. 12 showing how the slope of the back of the club head of FIGS. 10 and 11 is aligned with the club shaft.
Figure 14:
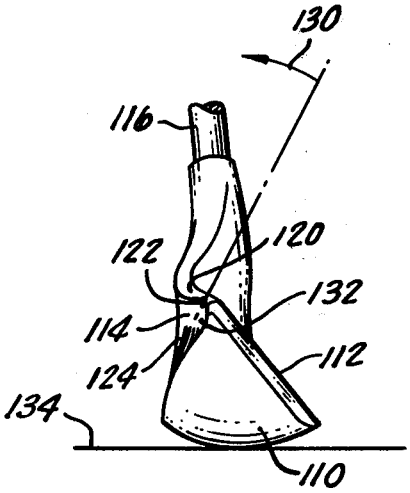
FIG. 14 is a side view of the club head of FIGS. 10 through 13.

FIG. 10 shows a modified, iron club head 110 having a front ball hitting surface 112 and a rear surface 114 therebehind. The complete club also has a shaft 116 (partially shown) connected to the club head 110 by the hosel 118. At the intersection of the top surface 120 and the back surface 114 of the club head 110, there is formed a small notch 122 which is analogous to the slot 76 in the club head 68 of FIG. 6. However, the notch 22, because of the generally triangular cross-section of the club head 110, can be aligned with one of a plurality of lines 124 or spaces 125 similar to those 78 shown for club head 68. This is shown in FIG. 10. These lines 124 and spaces 125, as can be seen in FIG. 11, are at an angle to what would normally be the level position line 126 of the club head 110. However, when the golfer's eyes and the club head 110 are in proper alignment for an iron shot along line 127, the lines 124 and spaces 125 appear to the golfer as straight lines pointing the direction of expected ball travel shown by the dashed arrow 128. In this the iron club is different from a putter where the proper position for the golfer's eyes is directly over the club head. The proper side offset angle 66 as shown in FIG. 12 varies slightly with the physical characteristics of the golfer 10 such as high arm length, his torso length and his normal eye position. More than one line 124 and space 125 is provided so that the notch 122 can be aligned with one of the lines or spaces which establishes the correct angle 66 for the particular golfer. The lins 124 and spaces 125 are of course discontinuous to the notch 122. This allows the golfer to establish both the angle 66 and the correct shaft angle 130 by moving the club head 110 and shaft 116 until the lines 124 and the notch 122 seem to meet. This is shown in FIG. 10. This also is shown in greater detail in FIG. 14 and requires that the upper portion 132 of the back surface 114 be at a greater angle with respect to the ground 134 than the rest of the back surface 114 in which the lines 124 are engraved.

Therefore the embodiment shown in FIGS. 10 through 14 provides the same alignment information to the golfer as the club head of FIG. 6 but in addition more precisely supplies additional information as to the proper shaft angle and placement so that a more precise golf shot can be accomplished by the average golfer.

Thus there has been shown and described a novel invention to assist a golfer in the proper alignment of his clubs with the ball so that some of the variables involved in the geometrical problem of striking a golf ball are eliminated. Many changes, modifications, variations and other uses and applications of the subject invention will, however, become apparent to those skilled in the art after considering this specification and the accompanying drawings. All such changes, modifications, alterations, and other uses and applications which do not depart from the spirit and scope of the invention are deemed to be covered by this invention which is limited only by the claims which follow.

What is claimed is:

1. A golf club head for an iron including a ball striking surface having a center of percussion, an undersurface and means to enable alignment of the user's eyes with the line of desired motion of the golf ball and in a plane containing the line which is oriented at a predetermined angle from horizontal, said means include:

a pair of spaced, facing wall surfaces oriented at right angles to and behind the ball striking surface and at the predetermined angle from horizontal, said wall surfaces being parallel to define a slot and they extend rearwardly behind the ball striking surface in alignment with the center of percussion;

a back surface at an angle opposite from horizontal from said ball striking surface so that said head has a generally triangular cross-section;

a top surface adjacent said back surface, said facing wall surfaces forming a notch which extends partially down said back surface from said top surface; and at least one indicia line extending along said back surface in a position to be visually aligned with said notch, said indicia line being at an angle from vertical when said club undersurface is resting properly on the ground.

2. The golf club head defined in claim 1 wherein a plurality of indicia lines and spaces are provided on the back surface of said head, whereby said lines and spaces provide different correct angles for golfers of different dimensions.

3. The golf club head defined in claim 2 wherein said indicia lines stop before reaching said notch in said back surface, said back surface being shaped so that when said notch visually appears to form a continuation of an indicia line, said ball striking surface is properly positioned with respect to the golfer in a facewise direction.

4. The golf club head defined in claim 3 wherein the back surface of the head has an upper portion which is at a greater angle to the ground than the portion thereof on which said indicia lines are placed.

* * * * *